US008131176B2

(12) United States Patent
Le

(10) Patent No.: US 8,131,176 B2
(45) Date of Patent: Mar. 6, 2012

(54) AUTOMATIC INITIATION OF PRINT JOB PREPROCESSING BEFORE RELEASE OF PRINT JOB

(75) Inventor: Loc T. Le, San Jose, CA (US)

(73) Assignee: Ricoh Company, Ltd., Tokyo (JP)

( * ) Notice: Subject to any disclaimer, the term of this patent is extended or adjusted under 35 U.S.C. 154(b) by 628 days.

(21) Appl. No.: 12/327,199

(22) Filed: Dec. 3, 2008

(65) Prior Publication Data

US 2010/0135687 A1 Jun. 3, 2010

(51) Int. Cl.
*G03G 15/00* (2006.01)

(52) U.S. Cl. ..... 399/82

(58) Field of Classification Search ..... 399/82, 399/83, 87

See application file for complete search history.

(56) References Cited

U.S. PATENT DOCUMENTS 7,390,071 B2 6/2008 Walmsley et al.
7,392,950 B2 7/2008 Walmsley et al.
7,403,796 B2 7/2008 Silverbrook
2002/0071134 A1* 6/2002 Jackson et al. ..... 358/1.13
2003/0103777 A1* 6/2003 Nakamura et al. ..... 399/82
2004/0085558 A1* 5/2004 Minns et al. ..... 358/1.11

* cited by examiner

*Primary Examiner* — David Gray

*Assistant Examiner* — Gregory H Curran

(74) *Attorney, Agent, or Firm* — Duft Bornsen & Fishman, LLP

(57) ABSTRACT

Print job management information, including management actions performed by a press operator, is collected from a print job manager. An evaluator evaluates the collected print job management information using an evaluation algorithm to generate a predicted press-operator job release sequence of one or more of the print jobs. The evaluation algorithm may be adapted to predict print job release behavior of the press operator. A print job is selected in accordance with the predicted press-operator job release sequence. Print job preprocessing of the selected print job is initiated in the printing system, prior to actual release of the print job by the press operator. Actual print-job release information may be compared with a predicted job release sequence to revise the evaluation algorithm.

20 Claims, 4 Drawing Sheets

AUTOMATIC INITIATION OF PRINT JOB PREPROCESSING BEFORE RELEASE OF PRINT JOB

BACKGROUND

1. Field of the Invention

The invention relates to the field of printing systems, and in particular, to selection of a print job for print job preprocessing prior to release of the job by a press operator.

2. Discussion of Related Art

A large print job requires a long time for processing and printing. In a typical production printing environment, after a print job has been created, it is either stored or submitted to the print server of a printing system. Typically, a print job is submitted to a print server to be queued until a print shop operator (e.g., a press operator) releases the job to the printing system for processing and imprinting on printable medium. On the print server, a print job is generally held in a queue along with other print jobs awaiting release by the press operator. Generally, as presently practiced, actual processing of a print job in a printing system begins after a press operator releases the job to the printer. For example, upon release of a print job, the print content and a print job ticket of the released print job may be sent to a print controller in which software translates the print content to generate Pane Description Language (PDL), such as PostScript (PS) or Printer Command Language (PCL). Then, the print controller may interpret the PDL and the job ticket of the released print job to generate a command file that is further translated into a bitmap file (in a process commonly referred to as rasterizing or RIPping). The generated bitmap is then transmitted line by line to a marking device of the printing system. As used herein a "marking device" may be any suitable device to imprint the generated bitmaps on printable media such as paper. Marking devices may include, for example, ink-jet marking engines and electrophotographic marking engines. Further, marking engines may include cut sheet marking engines that manipulate and mark cut sheets of printable media and continuous form marking engines that manipulate a continuous feed of printable media and may also include finishing devices to cut, fold, staple, etc the final printed output. In other words, after release of a print job, the print job must go through a number of processing steps before it is actually ready for printing by a marking device. For example, for a large printing job, the processing time required for translating, interpreting, and RIPping a print job after its release by a press operator and before actual printing begins may be several minutes or even hours for a complex, large print job. During this time, the marking device is sitting idle as the print controller processes the print job data. On the other hand, once a bitmap of the print job has been created and actual printing has begun, the computing capacity and the software in the print controller are often under utilized until actual printing by the marking device is completed and a new print job is released by the press operator. A smaller print job requires less processing time, but the cumulative idle time resulting from processing and printing numerous print jobs, large or small, is significant. The idle time of various elements of a printing system in a production printing environment result in unused capacity of capital equipment and in reduced throughput of revenue-generating print jobs.

There is, therefore, a need in the printing industry, particularly in production printing environments, to reduce the idle time of printing system elements.

SUMMARY OF THE INVENTION

Embodiments of the present invention help to solve some of the problems described above by providing systems and methods in which print job management information is collected and evaluated to predict the sequence of job releases by a press operator. Based on the predicted sequence of job releases, one or more print jobs are selected for preprocessing before actual release of the print jobs. The print job is forwarded to the printing system for the print controller to begin the interpretation and rasterizing of the print job data in anticipation of the predicted release of the job by the press operator. As a result, the idle time of processing capacity in a printing system is reduced and the throughput of print jobs through the printing system is increased.

An exemplary embodiment in accordance with the invention of a method operable for reducing the printing time of a plurality of print jobs in a printing system includes collecting, from a print job manager, print job management information related to a plurality of print jobs in the printing system. The print job management information may include management actions performed by a press operator and related to one or more of the print jobs. The exemplary method further includes evaluating the print job management information using an evaluation algorithm to generate a predicted press-operator job release sequence of at least one of the print jobs. The evaluation algorithm may be adapted to predict print job release behavior of the particular press operator. The exemplary method further includes selecting a print job in accordance with the predicted press-operator job release sequence, and initiating print job preprocessing of the selected print job in the printing system.

In some embodiments, collecting print job management information, including management actions performed by the press operator, comprises monitoring an actual release sequence of at least one of the plurality of print jobs performed by the press operator. With this information, it is possible to compare the actual release sequence with the predicted press-operator job release sequence and to revise the evaluation algorithm in accordance with the comparison.

Some examples of print job management information include a print job size, a print job due date, a print job priority code, and a print job printing schedule. In some embodiments, collecting print job management information includes monitoring a frequency of management actions performed by the press operator, such as a frequency of computer mouse clicks performed by the press operator. In some embodiments, print job preprocessing of the selected print job is initiated prior to a release by the press operator of the selected print job. In some embodiments, initiating print job preprocessing comprises initiating translation of a print content of the selected print job into a page description language (PDL). In some embodiments, initiating print job preprocessing comprises initiating translation of a portable document format (PDF) of the selected print job. In some embodiments, initiating print job preprocessing comprises initiating interpretation of a PostScript of the selected print job. In some embodiments, initiating print job preprocessing comprises initiating RIPping a PDL of the selected print job into a bitmap. Some embodiments in accordance with the invention further comprise collecting printer processing information from the printing system; and using the printer processing information in the evaluation algorithm to improve the evaluating. Examples of printer processing information are job processing status, printer processing capacity, and printer processing availability.

An exemplary system in accordance with the invention for reducing the printing time of a plurality of print jobs comprises an information collector, an evaluator and a job selector. An information collector is operable to receive, from a print job manager, print job management information related to a plurality of print jobs in the printing system. An evaluator is operable to receive the management information from the information collector, and to evaluate the job management information using an evaluation algorithm to generate a predicted press-operator job release sequence of at least one of the plurality of print jobs in the printing system. In some embodiments, the evaluation algorithm is adapted to predict print job release behavior of the particular press operator. A job selector is operable to select a print job in accordance with the predicted press-operator job release sequence, and is further operable to initiate print job preprocessing of the selected print job in the printing system. In some embodiments, the information collector is operable to monitor an actual release sequence of at least one of the plurality of print jobs by the press operator, the evaluator is operable to compare the actual release sequence with the predicted press-operator job release sequence to generate comparison results; and the evaluator is operable to revise the evaluation algorithm using the comparison results. In some embodiments, the information collector is operable to monitor the frequency of management actions performed by the press operator related to a print job, and the evaluator is further operable to evaluate the frequency of management actions using the evaluation algorithm to generate the predicted press-operator job release sequence. The job selector may be operable to initiate print job preprocessing of the selected print job prior to a release of the selected print job.

An exemplary computer readable medium in accordance with the invention embodies programmed instructions that, when executed by a computer, perform a method for reducing the printing time of a plurality of print jobs by automatically initiating preprocessing of a print job in a printing system prior to release of the print job.

The invention may include other exemplary embodiments described below.

BRIEF DESCRIPTION OF THE DRAWINGS

The same reference number represents the same element or same type of element on all drawings.

DETAILED DESCRIPTION OF THE DRAWINGS

FIGS. 1-5 and the following description disclose specific exemplary embodiments of the present invention to teach those skilled in the art how to make and use the invention. For the purpose of this teaching, some conventional aspects of the invention have been simplified or omitted. Those skilled in the art will appreciate variations from these embodiments that fall within the scope of the present invention. Those skilled in the art will appreciate that the features described below can be combined in various ways to form multiple variations of the present invention. As a result, the invention is not limited to the specific embodiments described below, but only by the claims and their equivalents.

Figure 1:
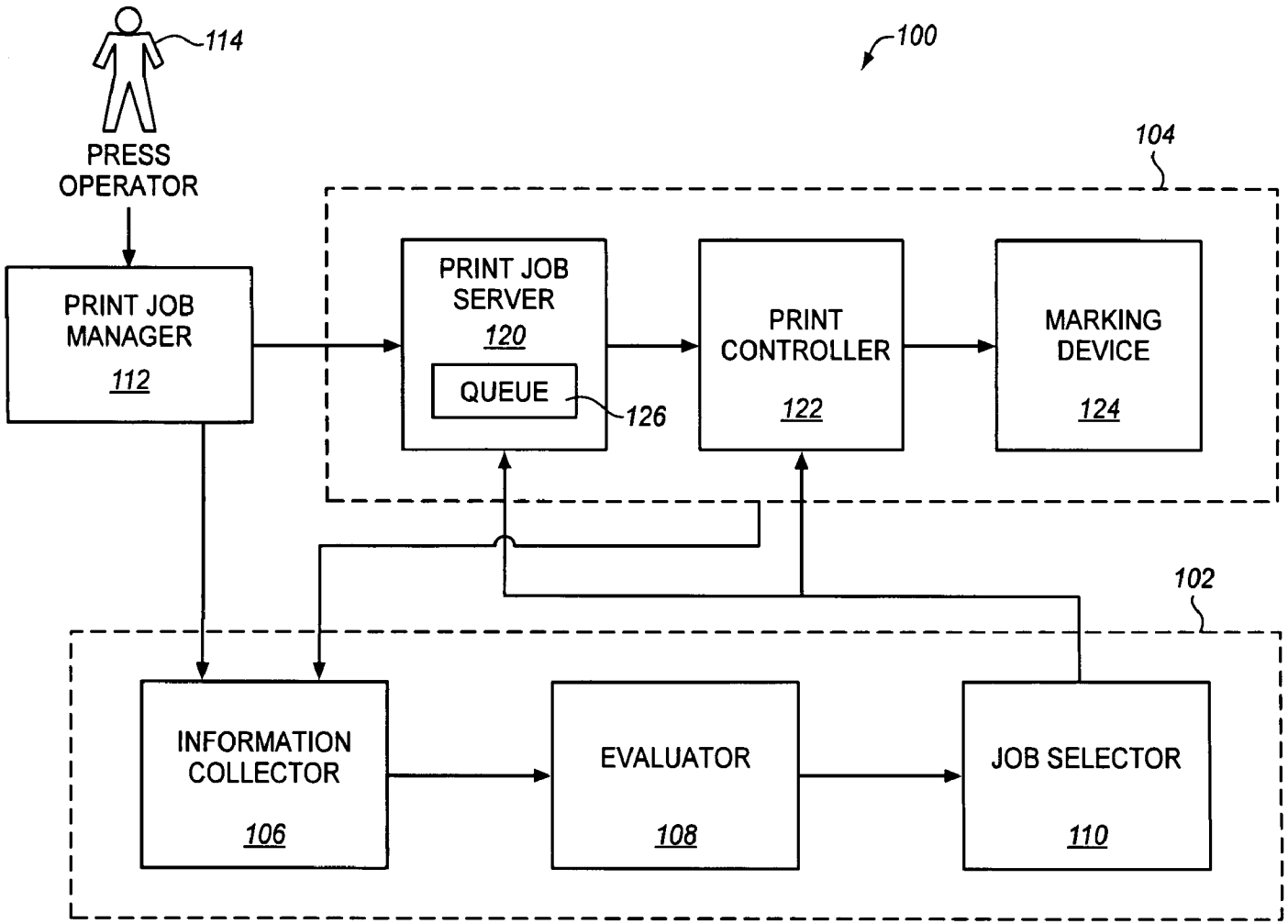
FIG. 1 depicts schematically an exemplary printing environment in accordance with an embodiment of the invention.

FIG. 1 depicts schematically an exemplary printing environment 100 including a system 102 in accordance with an embodiment the invention for reducing the printing time of a plurality of print jobs in a printing system 104. System 102 depicted in FIG. 1 comprises an information collector 106, an evaluator 108 and a job selector 110. Information collector 106 is operable to receive, typically from a print job manager 112, print job management information related to a plurality of print jobs slated for printing in printing system 104. An example of print job manager 112 is a computer having a keyboard and a graphical user interface GUI) as known in the art for submitting print jobs to printing system 104 and for managing the print jobs in printing system 104. In some embodiments, print job management information includes management actions performed by a press operator 114 related to one or more print jobs. Evaluator 108 is operable to receive management information from information collector 106 and to evaluate the job management information to predict print job release behavior of press operator 114. Evaluation of job management information in accordance with an embodiment of the invention includes using an evaluation algorithm to generate a predicted press-operator job release sequence of at least one of a plurality of print jobs to be printed in printing system 104. In accordance with an embodiment of the invention, the evaluation algorithm is adapted to predict print job release behavior of a particular human press operator 114. Job selector 110 is operable to select a print job in accordance with the predicted press-operator job release sequence generated by evaluator 108. Job selector 110 is further operable to initiate print job preprocessing of the selected print job in printing system 104. In accordance with an embodiment of the invention, job selector 110 is often able to initiate print job preprocessing of a selected print job prior to an actual release of the selected print job by the press operator. In such circumstances, preprocessing of the selected print job in the printing system is partially or completely performed before actual release of the print job by the press operator. This reduces the amount of time between release of a print job and the actual printing (i.e., marking) of a print job. More importantly, this system 100 utilizes the capacity of a printing system 104 more efficiently and increases throughput of print jobs through a printing system compared to printing environments of the prior art in which processing of a print job commences only after release of the print job by the press operator.

Although print job manager 112 is depicted in printing environment 100 of FIG. 1 as a single element, one of ordinary skill in the art will understand that a print shop manager in accordance with the invention may comprise one or more computers involved in preparing print jobs for submission to printing system 104. For example, in some embodiments, print job manager 112 comprises a pre-press-operator general computer to create a printing job, and further comprises a press-operator computer to interact with printing software of printing system 104. Also, although information collector 106, evaluator 108 and job selector 110 are depicted as three separate elements of system 102 depicted in FIG. 1, one of ordinary skill in the art will understand that the functional operability of information collector 106, evaluator 108 and job selector 110 may be implemented using one or several software modules located in one or several computing nodes.

Print job management information collected from print job manager 112 by information collector 106 and evaluated in evaluator 108 may include such information as print job size, a print job to date, a print job priority code, and a print job printing schedule. In some embodiments, information collector 106 is operable to monitor a frequency of management actions performed by human press operator 114 related to one or more print jobs, and evaluator 108 is operable to evaluate the frequency of management actions using an evaluation algorithm to generate a predicted press-operator job release sequence. For example, in some embodiments, information collector 106 is operable to monitor a frequency of computer mouse clicks performed by press operator 114 related to one or more print jobs, and evaluator 108 (adapted to predict print job release behavior of particular human press operator 114) is operable to use this information in predicting a press-operator job release sequence. In essence, a heuristic algorithm may predict a next job that may be released by a human press operator based the number of mouse clicks of the press operator looking at a particular print job queued in printing system 104.

In some embodiments of the invention, information collector 106 is operable to monitor an actual release sequence of at least one of a plurality of print jobs performed by press operator 114. Evaluator 108 is operable to compare the actual release sequence with a predicted press-operator job release sequence to generate comparison results. Evaluator 108 is then operable to revise the evaluation algorithm using the comparison results to improve its prediction capability with respect to the particular human press operator 114. For example, the heuristic algorithm may weight certain information more heavily than other information and those weighting factors in the algorithm may be altered as the actual sequence of released jobs is detected as compared to the predicted sequence.

After selecting a print job in accordance with the predicted press-operator job release sequence, job selector 110 is operable to initiate preprocessing of the print job in the printing system. For example, in some embodiments, job selector 110 causes a print job server 120 of a printing system 104 to release print content of a print job from its queue 126 to a print controller 122. In some embodiments, job selector 110 is operable to cause print controller 122 to begin translating the print content of a selected print job into PDL before actual release of the selected print job by the press operator. In some embodiments, job selector 110 is operable to instruct print controller 122 to interpret the PDL of a print job by RIPping of the selected print job to generate bitmaps for the logical pages of the print job before release of the selected print job by the press operator. As a result, in some circumstances, transmission of bitmap data from print controller 122 to marking device 124 of a printing system 104 begins sooner after actual release of a print job by press operator 114 than in printing environments that do not implement a system 102 in accordance with the invention.

In some embodiments in accordance with the invention, information collector 106 is further operable to collect printer processing information, such as job processing status, printer processing capacity, and printer availability from one or more printing systems 104. In some embodiments, evaluator 108 is further operable to evaluate the printer processing information and use it to generate the predicted press-operator job release sequence. For example, the collector may gather information from the print job server 120 and its queue 126 to determine when jobs were entered in the queue 126, the size of print jobs, etc. Further, collector 106 may gather information from the print controller 122 to determine its progress in the marking of a job presently sent to the marking device 124 and progress of the print controller 122 in preprocessing of another selected job sent to the printing system 104 for preprocessing based on an earlier prediction of the job release sequence.

Figure 2:
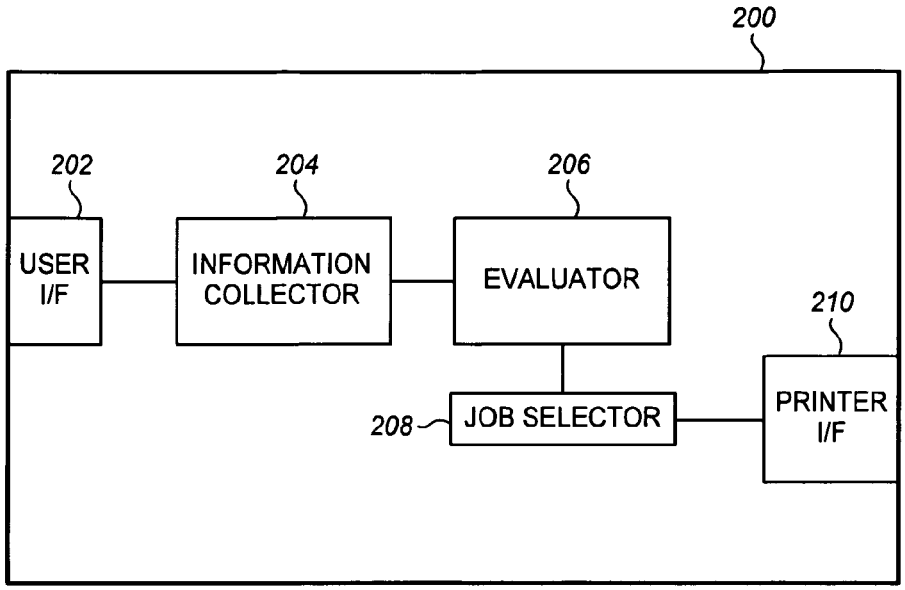
FIG. 2 depicts a diagram of software modules in an exemplary system in accordance with an embodiment of the invention for reducing the printing time of a plurality of print jobs in a printing system.

FIG. 2 depicts a diagram 200 of software modules in an exemplary system in accordance with an embodiment of the invention for reducing the printing time of a plurality of print jobs in a printing system by automatically selecting a print job for preprocessing and automatically initiating such preprocessing of the selected print job. User interface 202 includes software operable to interface with a press operator through a print job manager system, for example, print job manager 112 of system 100. Information collector 204 is operable to receive, typically from a print job manager 112, print job management information related to a plurality of print jobs slated for printing in a printing system. One of ordinary skill in the art will recognize that information collector software adapted to monitor and to collect print job management information may use various well-known techniques and structures to determine information about jobs presently queued for processing. In addition, collector 204 may gather information relating to previously queued print jobs from the printing systems themselves. Still further, collector may gather information regarding press operator management actions regarding the operator's apparent interest in a particular queued job. Evaluator 206 is operable to receive collected management information from information collector software 204 and to evaluate the job management information to predict print job release behavior of press operator 114.

Evaluation of job management information in accordance with the invention includes using an evaluation algorithm to generate a predicted press-operator job release sequence of at least one of a plurality of print jobs to be printed in a printing system. In accordance with the invention, the evaluation algorithm is adapted to predict print job release behavior of a particular human press operator 114. Evaluator software 206 may use one or more well-known techniques in one or more evaluation algorithms to generate a predicted press-operator job release sequence of one more print jobs slated for printing in a printing system. A straightforward heuristic for generating a predicted press-operator job release sequence is to predict that the next print job (i.e., the oldest print job) in a print server queue is the next one to be released by the press operator. A more sophisticated heuristic in an evaluation algorithm, and perhaps more accurate, is to calculate a score for each print job of a plurality of print jobs for which print job management information has been collected. An example of an equation for calculating such scores is:

$$\text{Score}=0.01t+0.5c+0.12s,$$

where t is the time elapsed (in minutes) since a job was submitted to a print shop or to a print job manager, c is the number of times (frequency) the press operator has viewed or edited the print job overall or within a certain time frame, and s is the job size (e.g., number of megabytes). The exemplary weighting factors 0.01, 0.5, and 0.12 express an exemplary weighting of these three factors in evaluating a score for each presently queued job. In this exemplary approach, in calculating the scores of print jobs, the evaluation algorithm assigns more to the score of a larger job than to a smaller job, more to the score of an older job than a to a newer job, and more to the score of a job receiving more attention (more clicks) than to a job receiving less attention. As explained above, in some embodiments, the information collector collects information regarding an actual release sequence of one or more print jobs performed by a press operator, and the evaluator compares the actual release sequence with the predicted press-operator job release sequence to generate comparison results, which the evaluator then uses to revise the evaluation algorithm. For example, in the exemplary heuristic presented here, if the frequency of press-operator actions (e.g., computer mouse clicks) has a particularly dominant effect on a positive correlation between the predicted press-operator job release sequence and the actual job release sequence, then the weighting factor for the corresponding term in the equation above may be increased accordingly.

Job selector module 208 is operable to select a print job in accordance with the predicted press-operator job release sequence generated by evaluator 206. Job selector 208 is further operable to initiate print job preprocessing of the selected print job in a printing system 104; for example by communicating through printer interface 210 with a print server 120 and/or a print controller 122. In accordance with the invention, job selector 206 is often able to initiate print job preprocessing of a selected print job prior to an actual release of the selected print job by the press operator.

Figure 3:
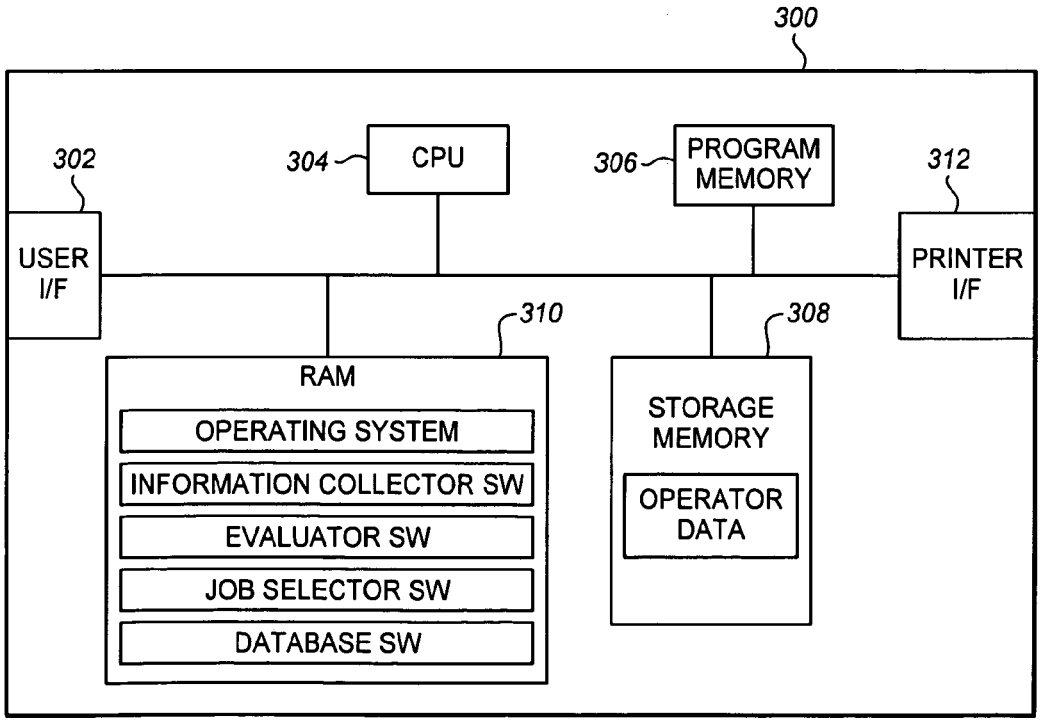
FIG. 3 depicts schematically a hardware system in accordance with an embodiment of the invention for reducing the printing time of a plurality of print jobs in a printing system.

FIG. 3 depicts schematically a hardware system 300 in accordance with an embodiment of the invention for reducing the printing time of a plurality of print jobs in a printing system. System 300 includes user interface 302 that utilizes interface software 202 to interface with a print job manager, for example, with print shop manager 112 of printing environment 100 depicted in FIG. 1. System 300 further includes a Central Processing Unit (CPU) 304, as known in the art. System 300 further includes storage memory 308, as known in the art. Examples of storage memory 308 include a disk drive. System 300 further includes Random Access Memory (RAM) 310, as known in the art. In some typical embodiments, information collector software 204, evaluator software 206 and job selector software 208, discussed with reference to FIG. 2, are stored in storage memory 308. Typically, during operation of system 300 in accordance with the invention, information collector software, evaluator software and job selector software are loaded into and executed from RAM 310. System 300 further includes a printer interface 312. In an exemplary embodiment, printer interface 312 is designed using techniques known in the art to interface in accordance with the invention with print job server 120 and/or print controller 122 of printing system 104, as depicted in FIG. 1.

Figure 4:
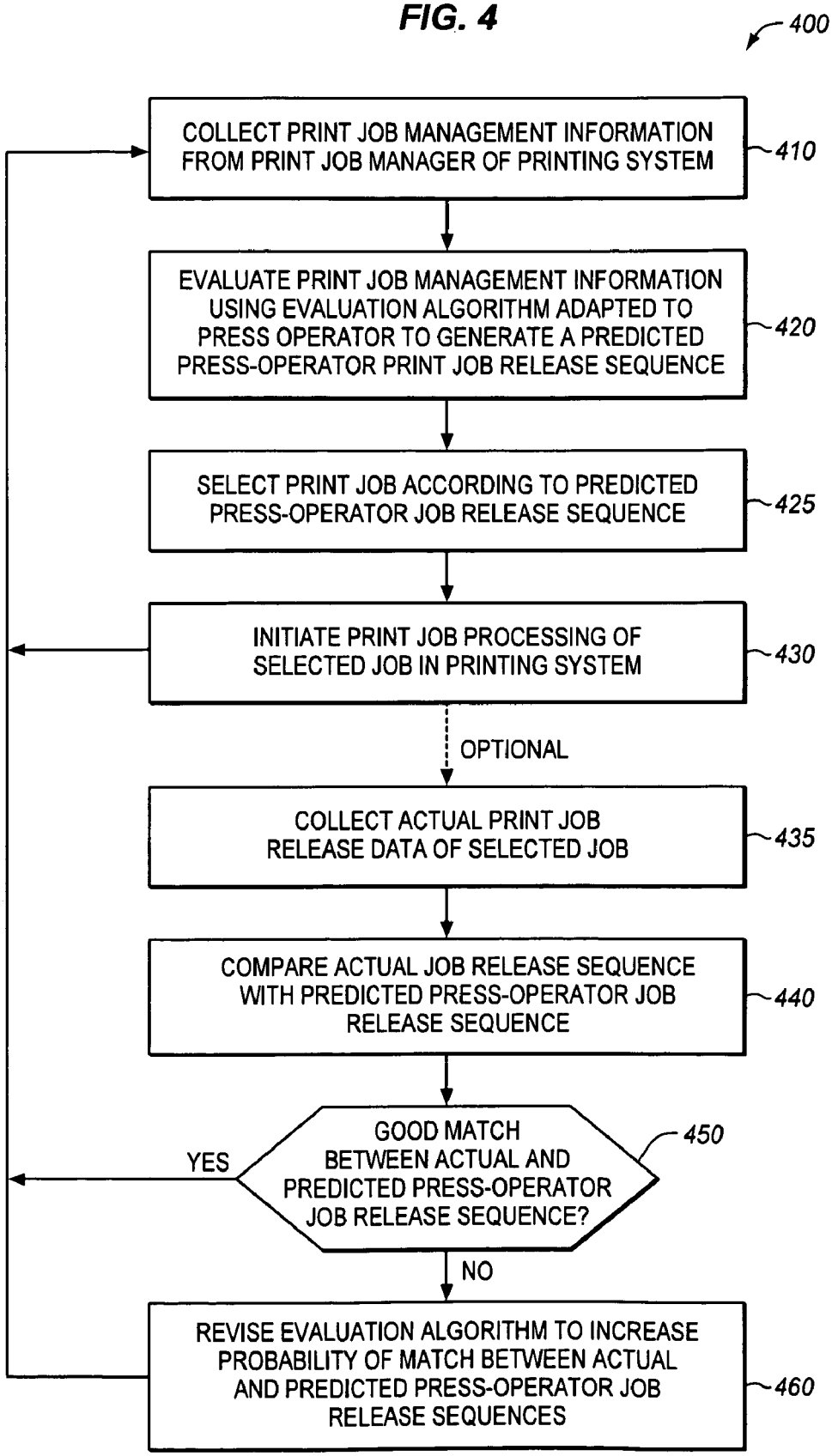
FIG. 4 depicts a process flowchart of an exemplary method in an embodiment of the invention.

FIG. 4 contains a process flowchart of an exemplary method 400 in an embodiment in accordance with the invention. Method 400 is described herein with reference to system 102 in printing environment 100, described above with reference to FIG. 1. One of ordinary skill in the art will understand, however, that a method in accordance with an embodiment of the invention may be practiced utilizing a system different from system 102 to reduce the printing time of a plurality of print jobs in printing systems different from that of printing system 104. Step 410 of method 400 includes collecting print job management information from print job manager 112. Print job management information may include such data as print job size, print job to date, print job priority code, and a print job printing schedule. Print job management information may also include print job management actions by a human press operator related to one or more print jobs. For example, in some embodiments, the frequency of mouse clicks (e.g., the total number of mouse clicks or the number of mouse clicks within a given time) performed by the press operator is monitored and collected. Typically, the press operator performs mouse clicks in a print job manager computer to consider the job for release, to schedule a print job, to check the status of a print job, to edit a print job, etc. For some press operators, the number of mouse clicks related to a particular print job performed by the press operator is an indicator of the imminence of release of the print job by the press operator. Other embodiments also collect information related to the actual release time and release sequence of one or more print jobs upon or after their release by the press operator. Step 420 includes evaluation in evaluator 108 of print job management information using an evaluation algorithm adapted to the press operator to generate a predicted press-operator print job release sequence. Step 425 includes selecting a print job in job selector 110 according to the predicted press-operator job release sequence. Step 430 includes automatically initiating preprocessing of the selected print job in printing system 104. In printing environment 100, job selector 110 communicates with print job server 120 and/or print controller 122 of printing system 104 to initiate print job preprocessing. Generally, after initiating preprocessing of a selected print job in step 430, steps 410, 420, 425 and 430 are repeated (step 432) to select a new print job and initiate its preprocessing. In some embodiments, in an optional step 435, actual print job release data of the selected print job is gathered by information collector 106. Then, in a step 440, the actual release sequence related to the selected print job is compared with the predicted press-operator job release sequence generated using the evaluation algorithm. The comparison of step 440 is generally performed in evaluator 108. A good match between the actual release sequence of a selected job and the predicted press-operator job release sequence suggests that the evaluation algorithm is well adapted to predict press-operator job-release behavior. In such case, steps 410, 420, 425 and 430 are repeated. In some embodiments, if there is not a good match between the actual and the predicted press operator job release sequences, then one or more evaluation algorithms are revised to increase the probability of a match in the future between actual and predicted press-operator job release sequences. Then, steps 410, 420, 425 and 430 are repeated.

Figure 5:
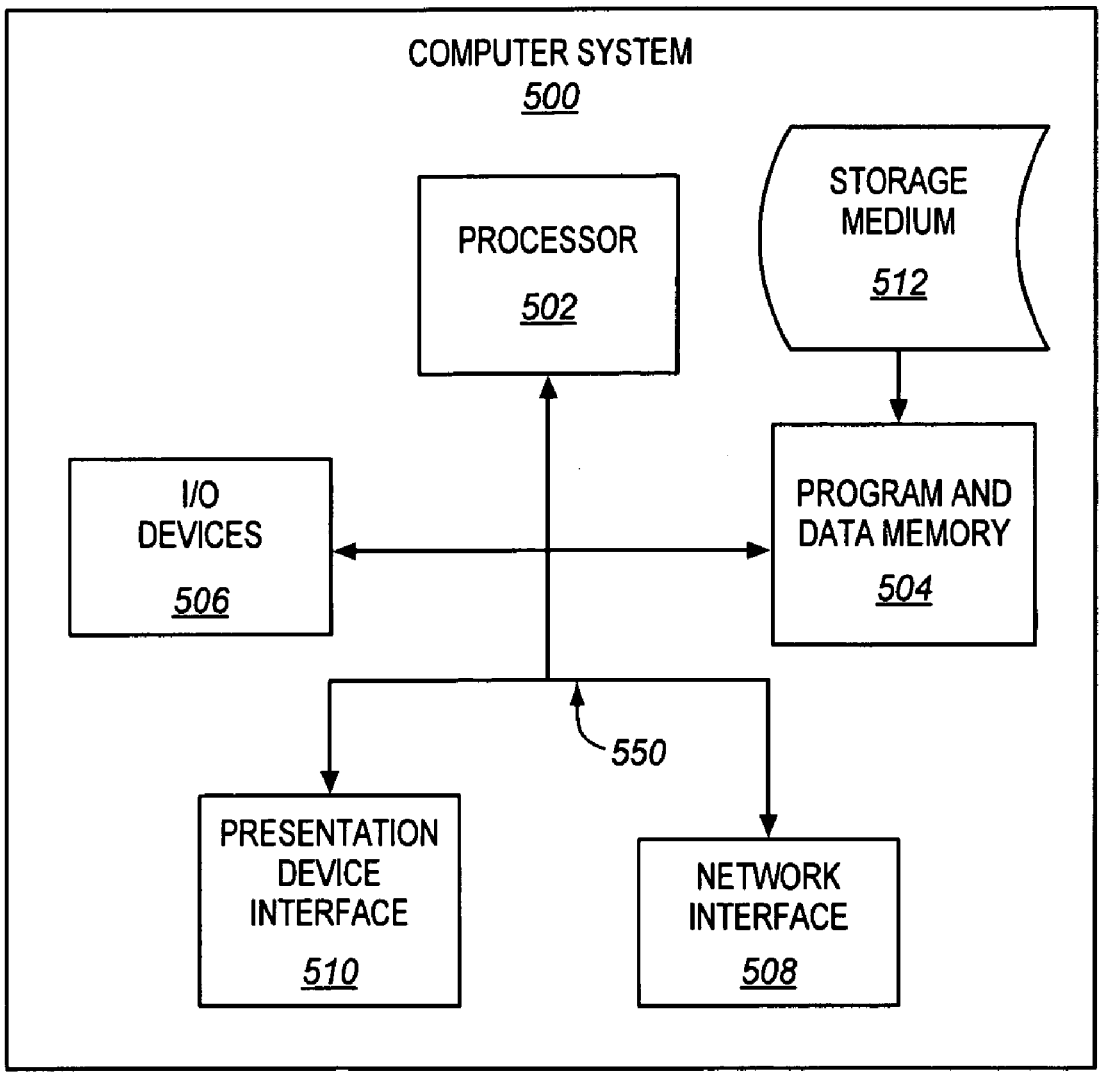
FIG. 5 is a block diagram depicting a computer system adapted to provide features and aspects of the present invention by executing programmed instructions and accessing data stored on a computer readable storage medium.

Embodiments of the invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 5 is a block diagram depicting a computer system 500 adapted to provide features and aspects hereof by executing programmed instructions and accessing data stored on a computer readable storage medium 512.

Furthermore, embodiments of the invention can take the form of a computer program product accessible from a computer-usable or computer-readable medium 512 providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A computer system 500 suitable for storing and/or executing program code will include at least one processor 502 coupled directly or indirectly to memory elements 504 through a system bus 550. The memory elements 504 can include local memory employed during actual execution of the program code, bulk storage, and cache memories which provide temporary storage of at least some program code in order to reduce the number of times code must be retrieved from bulk storage during execution.

Input/output or I/O devices 506 (including but not limited to keyboards, displays, pointing devices, etc) can be coupled to the system either directly or through intervening I/O controllers. Network adapter interfaces 508 may also be coupled to the system to enable the computer system 500 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 510 may be coupled to the system to interface to one or more presentation device such as printing systems and displays for presentation of presentation data generated by processor 502.

Although specific embodiments were described herein, the scope of the invention is not limited to those specific embodiments. The scope of the invention is defined by the following claims and any equivalents thereof.

I claim:

1. A method operable in a computer processing system for reducing the printing time of a plurality of print jobs, comprising:

collecting, from a print job manager, print job management information related to a plurality of print jobs in a printing system, said print job management information including management actions performed by a press operator related to one or more of said print jobs;

evaluating said print job management information using an evaluation algorithm to generate a predicted press-operator job release sequence of at least one of said print jobs, wherein said evaluation algorithm is adapted to predict print job release behavior of said press operator;

selecting a print job in accordance with said predicted press-operator job release sequence; and initiating print job preprocessing of said selected print job in said printing system.

2. A method of claim 1, wherein said collecting print job management information including management actions comprises monitoring an actual release sequence of at least one of said plurality of print jobs performed by said press operator; and further comprising:

comparing said actual release sequence with said predicted press-operator job release sequence; and revising said evaluation algorithm in accordance with said comparing.

3. A method of claim 1 wherein said print job management information includes one or more of a print job size, a print job due date, a print job priority code, and a print job printing schedule.

4. A method of claim 1 wherein said collecting print job management information including management actions performed by a press operator comprises:

monitoring a frequency of management actions performed by said press operator.

5. A method of claim 4 wherein said monitoring a frequency of management actions comprises:

monitoring a frequency of computer mouse clicks performed by said press operator and related to one or more print jobs.

6. A method of claim 1 wherein:

said initiating print job preprocessing of said selected print job comprises initiating print job preprocessing prior to a release by said press operator of said selected print job.

7. A method of claim 1 wherein said initiating print job preprocessing comprises:

initiating translation of a print content of said selected print job into a page description language (PDL).

8. A method of claim 1 wherein said initiating print job preprocessing comprises:

initiating translation of a portable document format (PDF) of said selected print job.

9. A method of claim 1 wherein said initiating print job preprocessing comprises:

initiating interpretation of a PostScript of said selected print job.

10. A method of claim 1 wherein said initiating print job preprocessing comprises:

initiating RIPping a PDL of said selected print job into a bitmap.

11. A method of claim 1, further comprising:

collecting printer processing information from said printing system; and using said printer processing information in said evaluation algorithm to improve said evaluating.

12. A system for reducing the printing time of a plurality of print jobs, comprising:

an information collector, said information collector being operable to receive, from a print job manager, print job management information related to a plurality of print jobs in said printing system, said print job management information including management actions performed by a press operator related to one or more of said plurality of print jobs;

an evaluator, said evaluator being operable to receive said management information from said information collector, and being operable to evaluate said job management information using an evaluation algorithm to generate a predicted press-operator job release sequence of at least one of said plurality of print jobs in said printing system, wherein said evaluation algorithm is adapted to predict print job release behavior of said press operator; and a job selector; said job selector being operable to select a print job in accordance with said predicted press-operator job release sequence, and being operable to initiate print job preprocessing of said selected print job in said printing system.

13. A system of claim 12 wherein:

said information collector is operable to monitor an actual release sequence of at least one of said plurality of print jobs by said press operator;

said evaluator is operable to compare said actual release sequence with said predicted press-operator job release sequence to generate comparison results; and said evaluator is operable to revise said evaluation algorithm using said comparison results.

14. A system of claim 12 wherein:

said information collector is operable to monitor the frequency of management actions performed by said press operator related to a print job; and said evaluator is operable to evaluate said frequency of management actions using said evaluation algorithm to generate said predicted press-operator job release sequence.

15. A system of claim 12 wherein:

said job selector is operable to initiate print job preprocessing of said selected print job prior to a release of said selected print job.

16. A non-transitory computer readable medium embodying programmed instructions that, when executed by a computer, performs a method for reducing the printing time of a plurality of print jobs, the method comprising:

collecting, from a print job manager, print job management information related to a plurality of print jobs in a printing system, said print job management information including management actions performed by a press operator related to one or more of said print jobs;

evaluating said print job management information using an evaluation algorithm to generate a predicted press-operator job release sequence of at least one of said print jobs, wherein said evaluation algorithm is adapted to predict print job release behavior of said press operator;

selecting a print job in accordance with said predicted press-operator job release sequence; and initiating print job preprocessing of said selected print job in said printing system.

17. A computer readable medium of claim 16, the method further comprising:

monitoring an actual release sequence of at least one of said plurality of print jobs performed by said press operator; and further comprising:

comparing said actual release sequence with said predicted press-operator job release sequence; and revising said evaluation algorithm in accordance with said comparing.

18. A computer readable medium of claim 16 wherein said collecting print job management information including management actions performed by a press operator comprises:

monitoring a frequency of management actions performed by said press operator.

19. A computer readable medium of claim 16 wherein:

said initiating print job preprocessing of said selected print job comprises initiating print job preprocessing prior to a release by said press operator of said selected print job.

20. A computer readable medium of claim 16, the method further comprising:

collecting printer processing information from said printing system; and using said printer processing information in said evaluation algorithm to improve said evaluating.

* * * * *

UNITED STATES PATENT AND TRADEMARK OFFICE

CERTIFICATE OF CORRECTION

PATENT NO. : 8,131,176 B2
APPLICATION NO. : 12/327199
DATED : March 6, 2012
INVENTOR(S) : Le et al.

It is certified that error appears in the above-identified patent and that said Letters Patent is hereby corrected as shown below:

In column 1, line 25, the text "Pane Description Language (PDL)" should read --Page Description Language (PDL)--

Signed and Sealed this
Eighth Day of May, 2012

David J. Kappos

David J. Kappos
*Director of the United States Patent and Trademark Office*